United States Patent [19]

Lüling

[11] Patent Number: 4,615,193

[45] Date of Patent: Oct. 7, 1986

[54] COMBINATION LOCK

[75] Inventor: Adalbert Lüling, Meinerzhagen, Fed. Rep. of Germany

[73] Assignee: Burg-Wächter KG Alfred Lüling, Meinerzhagen, Fed. Rep. of Germany

[21] Appl. No.: 582,772

[22] Filed: Feb. 23, 1984

[30] Foreign Application Priority Data

Mar. 8, 1983 [DE] Fed. Rep. of Germany ..... 3308054
Mar. 8, 1983 [DE] Fed. Rep. of Germany ..... 3308055
Mar. 8, 1983 [DE] Fed. Rep. of Germany ..... 3308056

[51] Int. Cl.[4] ..... E05B 37/16

[52] U.S. Cl. ..... 70/297; 70/317; 70/318; 70/320; 70/322; 70/323; 70/331; 70/332; 70/444; 70/445; 70/DIG. 59

[58] Field of Search ..... 70/297, 299, 286, 291, 70/294, 313–323, 326, 330, 331, 332, 442–446, DIG. 1, DIG. 2, DIG. 21, DIG. 59, 207, 209, 210, 213, 219

[56] References Cited

U.S. PATENT DOCUMENTS

| | | | |
|---|---|---|---|
| 186,268 | 1/1877 | Parise | 70/297 |
| 802,501 | 10/1905 | Fulton | 70/297 |
| 908,691 | 1/1909 | Nielsen | 70/297 |
| 943,471 | 12/1909 | Schoell | 70/DIG. 59 |
| 1,380,260 | 5/1921 | Somora | 70/425 |
| 1,538,479 | 5/1925 | Fleury | 70/314 |
| 2,275,362 | 3/1942 | Golden et al. | 70/380 |
| 2,869,351 | 1/1959 | Rolph | 70/370 |

FOREIGN PATENT DOCUMENTS

| | | | |
|---|---|---|---|
| 2552789 | 12/1982 | Fed. Rep. of Germany . | |
| 793232 | 11/1935 | France | 70/299 |
| 857868 | 4/1940 | France | 70/315 |
| 436964 | 10/1935 | United Kingdom | 70/316 |

*Primary Examiner*—Robert L. Wolfe
*Assistant Examiner*—Lloyd A. Gall
*Attorney, Agent, or Firm*—Spencer & Frank

[57] ABSTRACT

A combination lock has a locking bolt movable in bolt-opening and bolt-closing directions by a bolt-operating knob; a plurality of displaceable locking bars each having a predetermined position dependent upon a set combination; an arrangement for preventing the locking bolt from movement from a fully-closed position unless each locking bar is in its predetermined position; a plurality of displaceable code bars connected to the locking bars; a plurality of displaceable digit slides each having an externally accessible, manually engageable portion, a plurality of digit markings and a lug operatively engaging into the associated code bar; a movable carrier plate traversed by the lugs of the digit slides, whereby the locking bars, the code bars and the digit slides are displaced by the carrier plate during a motion thereof in a direction opposite the direction of movement of the locking bolt during opening. The bolt-operating knob is coupled with the carrier plate for moving the latter in a direction opposite the bolt-opening direction during displacement of the locking bolt in the bolt-opening direction.

18 Claims, 37 Drawing Figures

Fig. 13
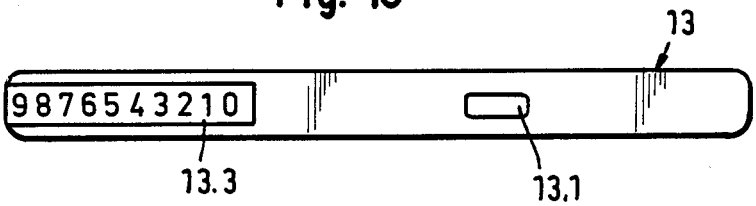
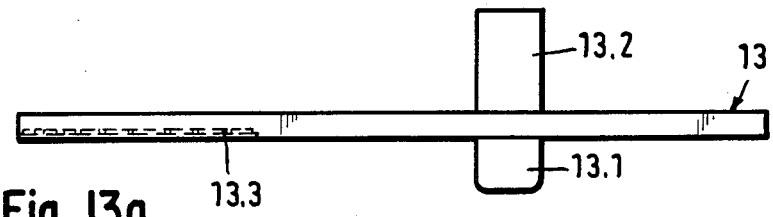
Fig. 13a
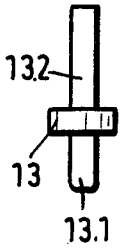
Fig. 13b
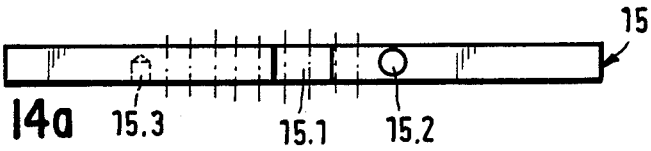
Fig. 14a
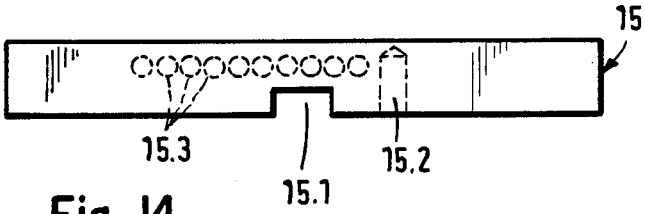
Fig. 14
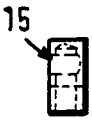
Fig. 14b
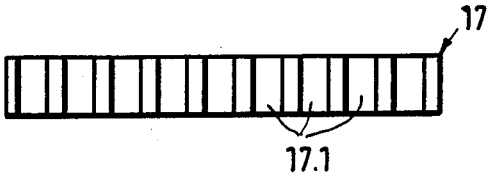
Fig. 15a
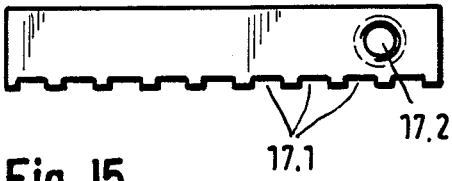
Fig. 15
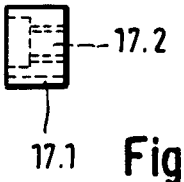
Fig. 15b Fig. 20
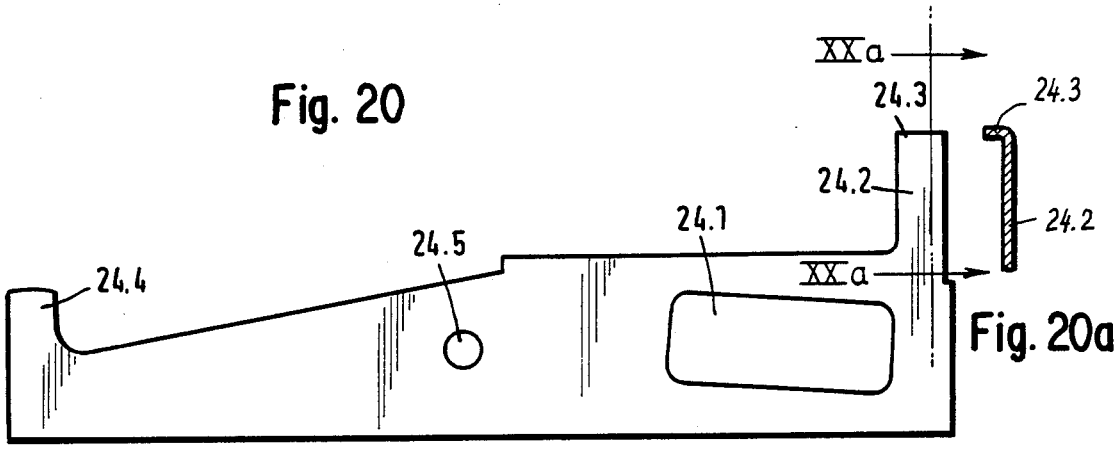
Fig. 20a
Fig. 19
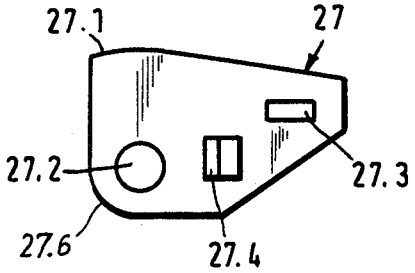
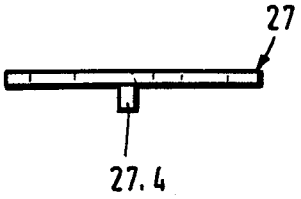
Fig. 19a

COMBINATION LOCK

BACKGROUND OF THE INVENTION

This invention relates to a combination lock for vaults, safes or the like and is of the type in which the combination is arbitrarily changeable; the opening movement of a locking bolt is effected by manually turning a bolt-operating knob after the set combination is properly dialed; for each digit of the combination a locking bar is provided which, in case the set combination was improperly dialed, prevents the opening motion of the locking bolt; and the visible display of the dialed combination disappears during the opening motion of the locking bolt. It is noted that the term 'dialing' is intended to include a shifting (linear) displacement of the digit-bearing lock component or components into the position corresponding to the set combination.

A combination lock for vaults, safes or the like has to meet essentially the following requirements:

(a) The possibility of setting or changing the combination without a disassembly of the lock;

(b) Protection against monitoring the combination by scanning or listening;

(c) Preventing the locking bolt of the combination lock from opening in case of improper dialing of the combination and/or by force;

(d) Cancelling the visual display of the combination as early as the opening motion of the locking bolt.

In a known combination lock disclosed, for example, in German Pat. No. 2,552,789, for the opening of the locking bolt a manipulator is provided which also serves for dialing the combination. A number of gear wheels rotatable by the shiftable manipulator are mounted in series on the shaft of the manipulator. Each gear wheel meshes with a toothed rack having notches into which locking projections of a tumbler mechanism may extend. The tumbler mechanism has a plurality of immobilizable tumbler plates on which the locking projections are provided and which are assigned individually to the toothed racks and combined into a raising and lowering unit held in a disengaging position by return springs. The unit carries a locking pawl which immobilizes the locking bolt in the disengaging position. For shifting the locking plates for the purpose of resetting the combination, an eccentric pin coupled in the shifting direction with the raising and lowering unit is provided with an actuating head which, after opening of the door served by the combination lock, is accessible through an opening in the lock housing. The manipulator may be coupled with a bolt-actuating disc having actuating components such as entraining projections, ribs and a slot in such an arrangement that upon rotating the manipulator subsequent to dialing the combination, the raising and lowering unit is moved, in an initial rotational phase, into the engaging position against the force of the return springs. In the engaging position, the locking projections extend into the notches of the toothed racks and, as a result, the locking pawl releases the locking bolt. Upon rotation of the manipulator (after clearing the locking arrangement) beyond a predetermined position, the display of the combination visible from the outside is cancelled. Upon further rotation the locking bolt is retracted, whereby the raising and lowering unit is released and is moved rearwardly by the return springs into the disengaging position.

The known combination lock of the above-discussed type is disadvantageous in that it has a cluttered construction; it is circumstantial to set and to dial the combination; the device which cancels the display of the combination is complex; and the lock mechanism operates with a great number of movable components without improving operational safety and security.

SUMMARY OF THE INVENTION

It is an object of the invention to provide an improved combination lock of the above-outlined type which is of simple construction, and in which, while preserving the greatest possible safety and security, the setting and the dialing of the combination as well as the cancellation of the visible display of the combination during the opening motion of the locking bolt are effected in a simple manner.

These objects and others to become apparent as the specification progresses, are accomplished by the invention, according to which, briefly stated, each locking bar of the combination lock is coupled with a separate code bar into which engages a lug of a digit slide which may be shifted from the outside. The lug of each digit slide passes through the door and through a carrier plate situated between the door and the code bars. The carrier plate is moved, by means of a bolt-operating knob, in a direction opposite to the opening motion of the locking bolt after clearing the locking bars.

In a combination lock according to the invention, the locking bars may be placed into the proper opening position in a simple manner by the digit slides with the intermediary of the respective code bars. In a similarly simple manner, the visible display of the combination is cancelled by virtue of the fact that the lugs pass through a carrier plate which is situated between the door and the code bars. The carrier plate is moved by the bolt-operating knob during the second half of the opening motion in a direction opposite to the opening motion of the locking bolt, in the sense of cancelling the display of the combination. The entrainment of the lugs is effected in a simple manner by virtue of the fact that they first pass through windows provided in the carrier plate. A transverse member bounding the windows at their rear edge entrains all the lugs. Between a half-open and a fully-open position, the combination lock may be opened without dialing the combination anew. Only when the combination lock again assumes its fully closed position, dialing of the combination has to be effected again for opening the combination lock.

According to additional features of the invention, each locking bar is guided in a grooved plate supported in a lock housing and is connected with a code bar by means of a setting screw which, in the dialed position, is accessible through an aperture provided in a lock plate covering the lock housing from the inside. The code bars are guided in engagement with the grooved plate between detent bars arranged in the plane of the code bars. Each code bar is provided with an aperture for receiving the lug of the externally operable digit slide.

In a combination lock incorporating the above-outlined additional features, the mechanism of the combination, on the one hand, and the mechanism for bolting and unbolting, on the other hand, are actuated by separate actuating devices. The combination mechanism includes linearly displaceable digit slides guided parallel to one another in a slide-supporting plate. Each digit slide engages into a code bar which, in turn, is connectable with a locking bar in an arbitrarily selectable position relative thereto. For setting the combination, that is, to arbitrarily set the relative position between the code bar and the locking bar, first the then operative combination has to be dialed. As a result, behind the hole in the lock assembly plate the setting screw becomes accessible which may thus be unscrewed and then screwed back in a new position of the code bar relative to the locking bar. The dialed combination appears for each bar behind an observation window provided in the slide-supporting plate. If for all the digit slides the set digit appears behind the observation window, that is, the combination has been properly dialed, the leading end of all the locking bars lie in the same plane. This means that the locking bars may be traversed by a toothed plate which is moved upon actuation of the bolting mechanism.

The combination lock according to the invention has an uncluttered construction which is easily overseeable. The combination may be set in a simple manner and all requirements for a secure combination lock are met.

According to a further feature of the invention, a drive plate which is moved by the bolt-operating knob during its rotation, is displaceable by means of a pivot-and-carrier pin with the locking bolt and a rocker plate in the direction of motion of the locking bolt. The drive plate is pivotally held and is spring-biased. A tip of the rocker plate engages a locking plate which is pivotal in a toothed plate. The toothed plate abuts against the improperly positioned locking bars, but if all the locking bars are in the proper position corresponding to the set combination, the toothed plate is movable transversely to the locking bolt past the end faces of the locking bars.

The coupling of the drive plate, the locking bolt and the rocker plate by means of a pivot-and-carrier pin provides for a superposition of a longitudinal motion executed by the drive plate and the rocker plate together with the locking bolt and a relative pivotal motion between the drive plate and the rocker plate. An outward pivoting of the rocker plate, however, is possible only if all the locking bars are situated between the boundary legs of the toothed plate. In such a case, the rocker plate lifts the toothed plate by means of the locking plate and thus clears the way for the motion of the locking bolt. Even if a single locking bar is not in its position according to the set combination, the toothed plate abuts against such a locking bar and thus prevents a pivotal motion of the rocker plate with respect to the locking plate. Once the rocker plate has cleared the way for the motion of the locking bolt—because all the locking bars are in the proper position corresponding to the set combination—the toothed plate can drop back into its initial (starting) position. Between such a half-closed position and the fully-open position the combination lock may be closed or opened regardless of whether the locking bars are in their position corresponding to the set combination. It is thus feasible to scramble the combination during such a closing step.

BRIEF DESCRIPTION OF THE DRAWINGS

FIGS. 13, 13*a* and 13*b* are respective side elevational, top plan and end elevational views of a digit slide of the preferred embodiment.

FIGS. 14, 14*a* and 14*b* are respective side elevational, top plan and end elevational views of a code bar of the preferred embodiment of the invention.

FIGS. 15, 15*a* and 15*b* are respective side elevational, bottom plan and end elevational views, on an enlarged scale, of a locking bar of the preferred embodiment of the invention.

FIGS. 19 and 19*a* are respective side and end elevational views of a locking plate of the preferred embodiment.

FIG. 20 is a side elevational view of a rocker plate of the preferred embodiment.

FIG. 20*a* is a fragmentary sectional view along line XXa—XXa of FIG. 20.

DESCRIPTION OF THE PREFERRED EMBODIMENT

Figure 1:
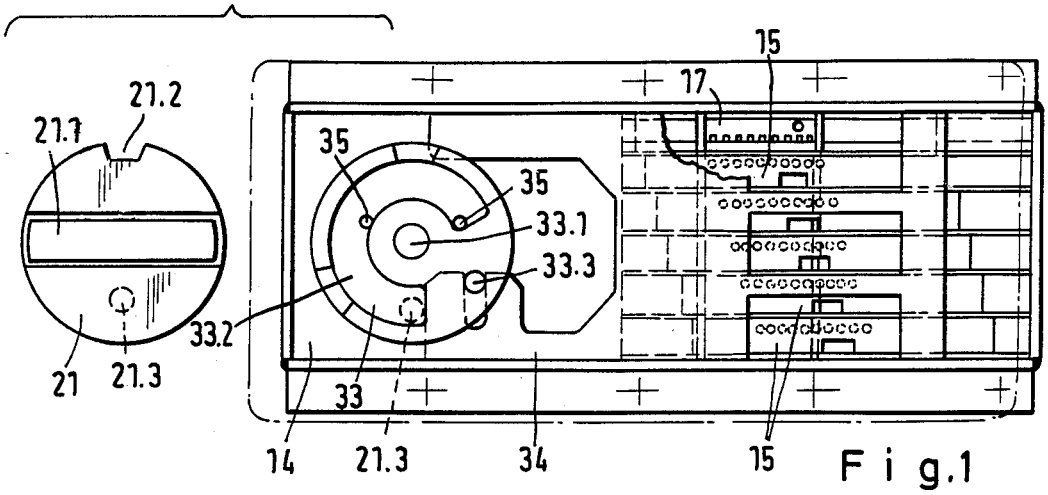
FIG. 1 is an elevational view of a combination lock according to a preferred embodiment of the invention, as seen from the direction of a door on which the lock is mounted, shown in a fully bolted position, with the combination properly dialed.

Turning first to FIGS. 11, 13, 13*a* and 13*b*, on a door 11 of, for example, a safe, there is externally mounted a slide supporting and guiding plate 12 provided with slots (one shown at 12.1 in FIG. 11) in which digit slides 13 are guided, each having a bar or strip-like configuration. On its frontal face each digit slide 13 is provided with a handle 13.1, whereas on its reverse face, in alignment with the handle 13.1, each digit slide 13 has a lug 13.2. Each digit slide 13 is displaceable from the outside by manual engagement of the handle 13.1. The lug 13.2 transmits any shifting motion of a respective digit slide 13 to other components of the combination lock as will be described below. On the frontal face of each digit slide 13 there is further provided a digit zone 13.3 on which there are provided, for each digit slide 13, a plurality of digits or letters; in the present example there are provided digits from 0 to 9. Behind windows (one shown at 12.2 in FIG. 11) provided in the slide-supporting plate 12 one digit appears according to the shifted position of the digit slide 13. According to the set combination—which is effected in a manner to be described below—to each slide 13 there is assigned a certain position and thus a predetermined digit. The door 11 can be opened only if all the digit slides 13 have reached their position corresponding to the set combination and in the windows the associated digits are being displayed, that is, the combination has been dialed. The described embodiment has six digit slides 13 which provide for millions of combinations.

Figure 11:
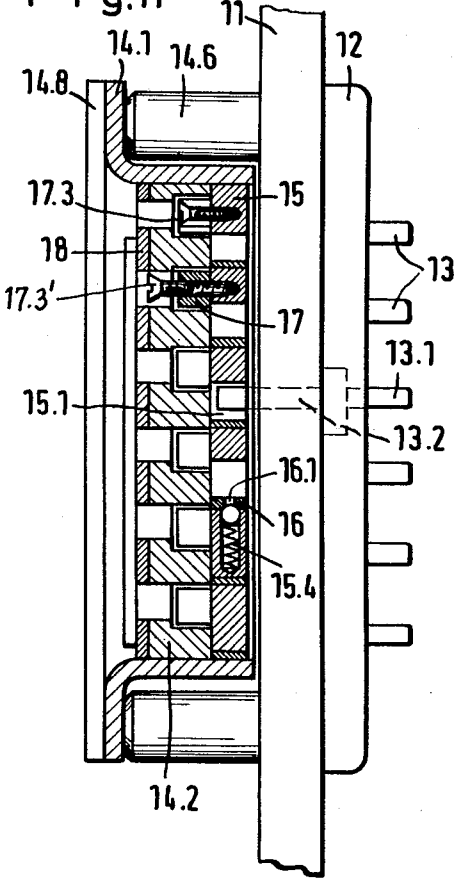
FIG. 11 is a sectional view taken along line XI—XI of FIG. 10.

Also referring to FIGS. 12, 12*a*, 12*b* and 12*c*, on the inside of the door 11, in alignment with the slide-supporting plate 12, there is mounted a lock housing 14 which accommodates the combination lock and which is designed to guide the lugs 13.2 of the digit slides 13. The housing 14 is formed essentially of two elongated, parallel-arranged mounting angles 14.1 between which there is secured a grooved plate 14.2 which has, on its side oriented towards the door 11, longitudinally extending grooves 14.3. In the zone of the locking mechanism the grooved plate 14.2 is free from grooves. In the grooveless zone, on the grooved plate 14.2 there is arranged a solid plate 14.4 having an opening for guiding the drive of the locking mechanism. Transversely to the grooves 14.3 between the mounting angles 14.1 of the housing 14 two parallel-extending transverse slots 14.5 are provided. As shown in FIG. 11, with the aid of stationary pins 14.6 passing through holes 14.7 provided in the mounting angles 14.1 the housing 14 is secured to the door 11 in such a manner that the angle legs of the mounting angles 14.1 extend parallel to the door 11.

Also referring to FIGS. 14, 14*a* and 14*b*, adjacent the bolting part of the door 11 there are held or guided in the housing 14 code bars 15 which are coupled with the digit slides 13. On the code bars 15, in the same plane therewith, there are arranged detent bars 16, while on the code bars 15, on their face oriented away from the door 11, there are mounted locking bars 17. In the housing 14 there is further supported a toothed plate 18 and a locking bolt 19.

Each code bar 15 has along its lower edge a rectangular opening 15.1 and, parallel thereto, a bore 15.2 extending from the same edge. Transversely to the bore 15.2, in a side wall there extend in a single row ten parallel-arranged and uniformly spaced threaded bores 15.3. As shown in FIG. 11, into the opening 15.1 extends the lug 13.2 of the respective digit slide 13. By virtue of this arrangement, the digit slide 13, upon its displacement to a preset digit, carries with it the code bar 15. The bore 15.2 receives a ball detent 15.4 whose ball engages the respective detent bar 16. For this purpose, the detent bar 16 has a series of bores 16.1 oriented towards the code bar 15. The distance between the bores 16.1 is identical to that between the threaded bores 15.3 of the code bar 15. In this manner, definite positions ("click stops") for the code bar 15 are provided. While in FIG. 14, as noted above, the bore 15.2 extends from the same edge of the code bar 15 where the opening 15.1 is provided, it is feasible to place the bore 15.2 in the opposite edge. Such an arrangement is shown in FIG. 11, where the ball detent 15.4 received in the bore 15.2 of the code bar 15 is oriented upwardly to cooperate with a detent bar 16 situated above the code bar 15. The threaded bores 15.3, as will be described below, provide for setting and resetting the combination.

Figures 12, 12A, 12B, 12C:
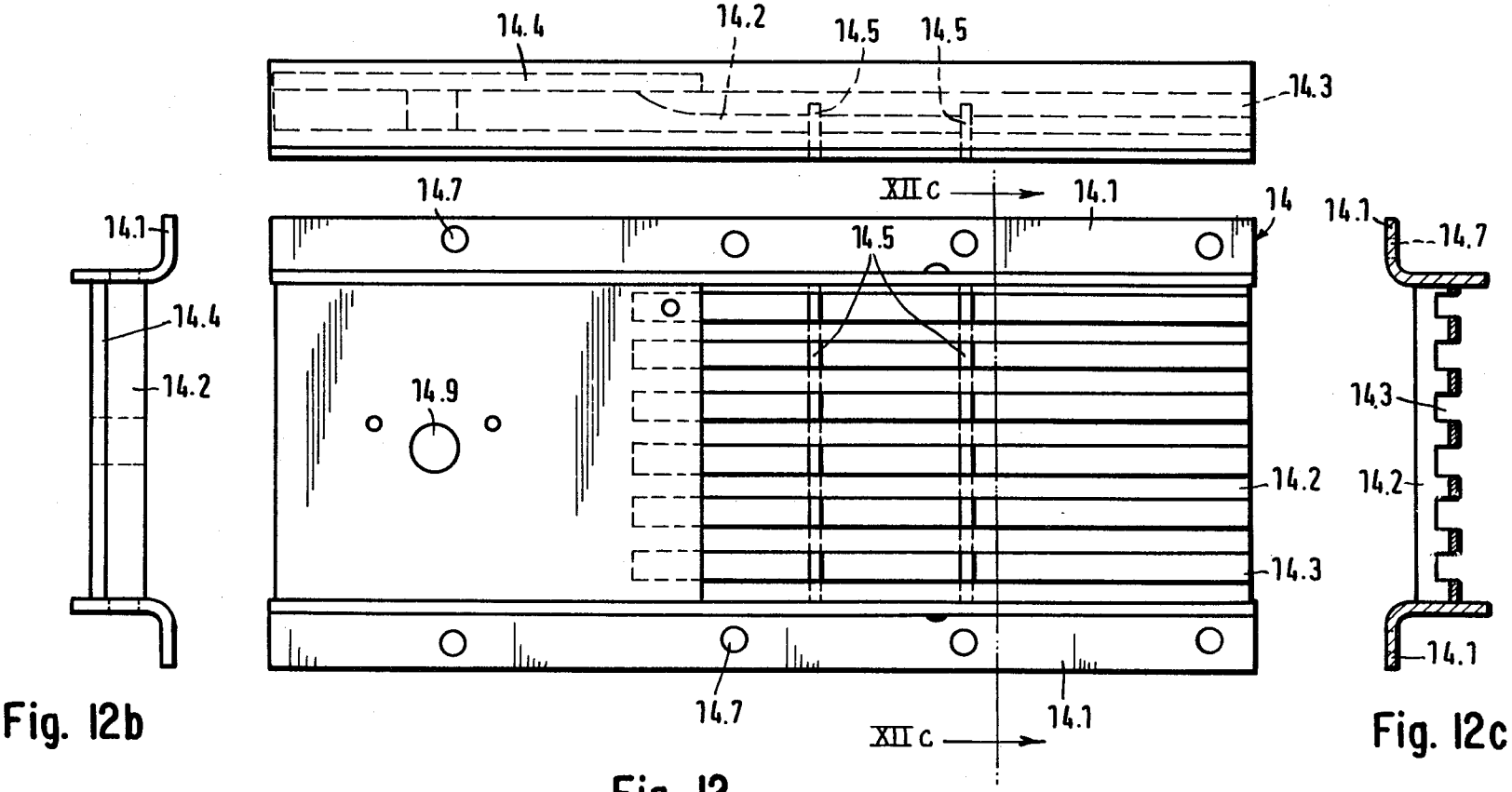
FIGS. 12, 12*a* and 12*b* are respective side elevational, top plan and end elevational views of a slide guiding plate of the preferred embodiment.
FIG. 12*c* is a sectional view along line XIIc—XIIc of FIG. 12.

Turning now to FIGS. 15, 15*a* and 15*b*, each locking bar 17 has on one side face a series of groove-like depressions 17.1 having a rectangular outline to form together a toothed rack. Transversely to the lateral side of each locking bar 17, in the vicinity of one end thereof, there is provided a throughgoing threaded bore 17.2. The depressions 17.1 protect the combination lock against monitoring in a manner described below. As shown in FIG. 11, the threaded bore 17.2 receives a setscrew 17.3, by means of which the locking bar 17 is connected with the code bar 15. If—for changing the combination—the locking bar 17 is to be connected with the code bar 15 in a different position, the setscrew 17.3 is unscrewed from the code bar 15, but remains threadedly engaged in the locking bar 17 for preventing the screw from dropping out, as shown at 17.3' in FIG. 11. The setscrew 17.3 is accessible through holes (one shown at 14.10) provided in a series in a base plate 14.8. After unscrewing the setscrew 17.3 into the position 17.3', the respective code bar 15 is, by means of the digit slide 13, moved into its position corresponding to the new combination. The position is defined by the ball detent 15.4, in cooperation with the detent bar 16. Thereafter, the setscrew 17.3 is, in the selected position, screwed into another threaded bore 15.3 of the code bar 15. The detent bar 16 is supported by the adjoining face of the grooved plate 14.2 which guides the locking bars 17 in the grooves 14.3 (FIG. 12). The code bars 15 are guided, on the one hand, between adjoining detent bars 16 and, on the other hand, on the adjoining surfaces of the grooved plate 14.2.

Figure 16:
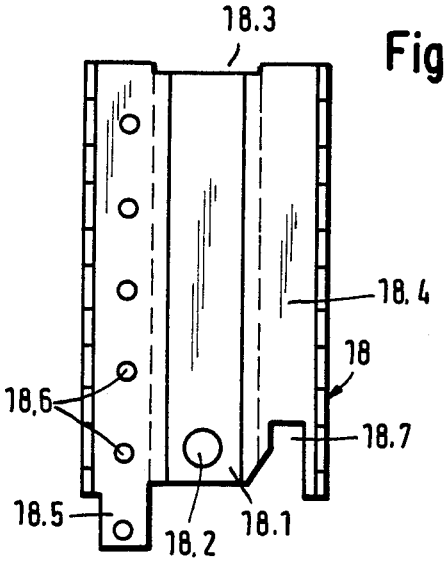
FIGS. 16, 16*a* and 16*b* are respective side elevational, top plan and end elevational views of a toothed plate of the preferred embodiment.
Figure 16B:
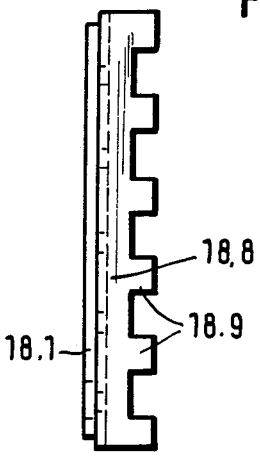
Figure 16A:
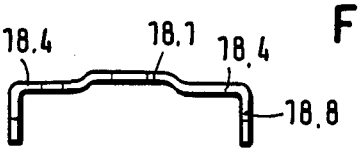

Turning now to FIGS. 16, 16*a* and 16*b*, the toothed plate 18 has a clip-like configuration as best seen in FIG. 16*a*. The toothed plate 18 has a central raised strip portion 18.1 which, close to an end of the toothed plate 18, has a hole 18.2 and at the opposite end has a shallow, rectangular cutout 18.3. On both sides of the raised central strip 18.1 there are provided planar lateral faces 18.4. One of the lateral faces 18.4 is extended beyond one of the plate ends to continue as a tab 18.5 and is provided with a series of holes 18.6. The other lateral face 18.4 of the toothed plate 18 is, on the same side as the tab 18.5, provided with a cutout 18.7 which has a rectangular inner area that opens trapezoidally towards the plate end. The toothed plate 18 has legs 18.8 along opposite longitudinal edges. The legs 18.8 extend perpendicularly to the lateral faces 18.4 and are oriented away from the raised central strip 18.1 and are provided with teeth 18.9 at their free edges.

Figure 4:
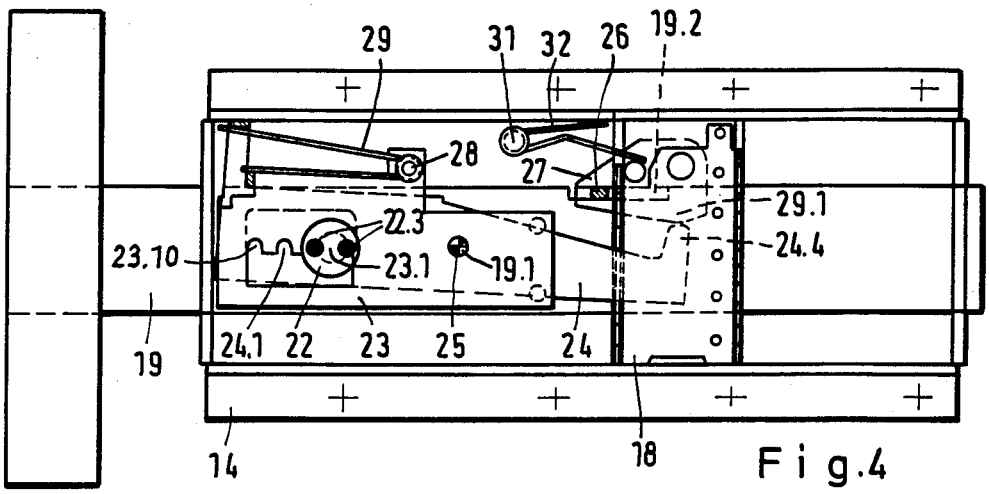
FIG. 4 is an elevational view of the locking mechanism of the combination lock in which the locking bolt is in the closed (fully bolted) position.

As seen, for example, in FIG. 4, the toothed plate 18 straddles transversely the housing 14 in the zone of the locking bars 17. The inner width of the toothed plate 18, that is, the distance between the legs 18.8 equals the length of each of the locking bars 17. The division of the teeth 18.9, that is, the distance between two adjoining teeth 18.9 equals the division of the grooved plate 14.2, that is, the distance between two adjoining grooves 14.3. Thus, each locking bar 17 may be displaced by means of its associated digit slide 13 with the intermediary of the respective code bar 15 connected with the respective slide 13 to which the locking bar 17 is attached by connecting screw 17.3; such displacement may take place through spaces defined between adjoining teeth 18.9. As the code bar 15 reaches its position corresponding to the set combination, the associated locking bar 17 is situated precisely between the legs 18.8 of the toothed plate 18. In order to be able to open the combination lock, a displacement of the toothed plate 18 transversely to the housing 14 is required. If all the locking bars 17 assume their proper position between the legs 18.8 of the toothed plate 18, such an opening motion may be performed. If, however, even a single locking bar 17, because of an improper positioning of the associated code bar 15, is not situated between the legs 18.8 of the toothed plate 18, the toothed plate 18, with the teeth 18.9, abuts against the improperly positioned lock bar 17 and thus an opening of the combination lock is prevented.

Figure 10:
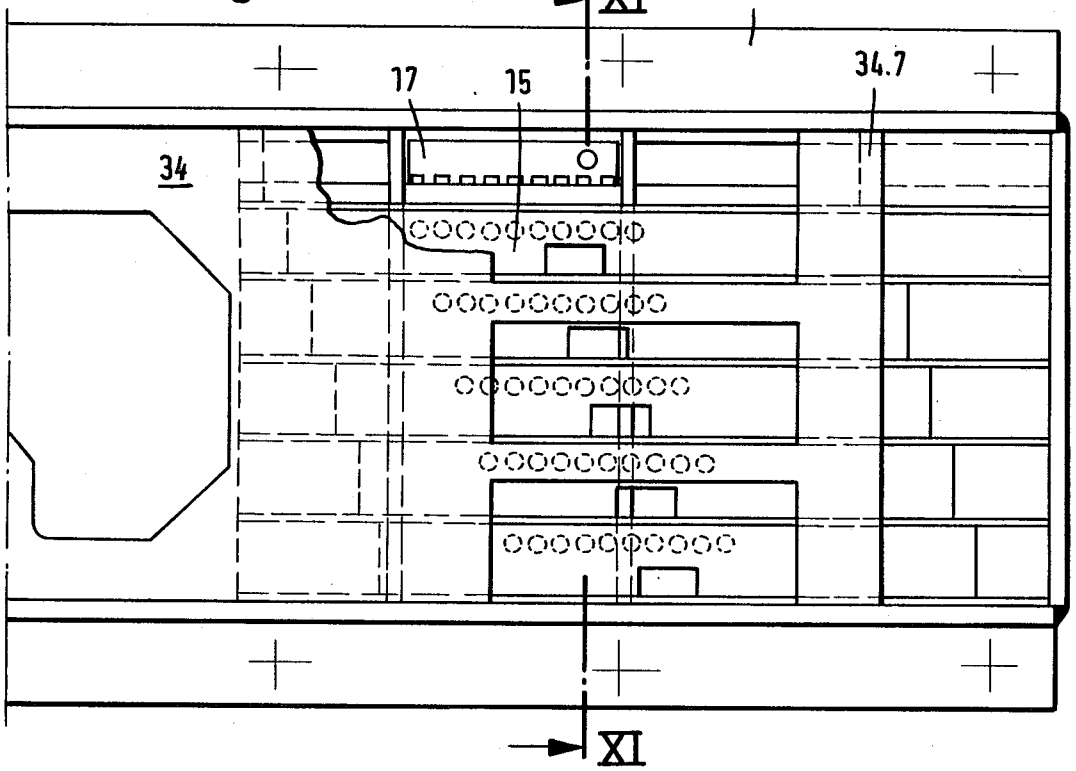
FIG. 10 is an enlarged detail of FIG. 1.

Turning now to FIG. 10, six digit slides 13 are placed—as viewed downwardly from the top—to positions 1-2-3-4-5-6, respectively. In this position, the toothed plate 18 may clear all six locking bars 17 and thus the combination lock may be opened.

As shown, for example, in FIG. 1, on the outside of the door 11, adjacent the digit slides 13 in the longitudinal direction thereof, there is mounted a rotatable bolt-operating knob 21 (shown laterally removed for clarity). The bolt-operating knob 21 rotates a drive shaft 22 which, as shown in FIG. 4, engages into a drive plate 23.

The bolt-operating knob 21 which is of circular disc-shaped configuration has, on its front side, a raised cross bar 21.1 which extends diametrally across the knob 21. An observation window 21.2 cut out along the circumference of the knob 21 is in alignment with a halving center line extending perpendicularly to the cross bar 21.1. To the side of the bolt-operating knob 21 remote from the window 21.2 there is secured, to the rear face thereof, a carrier pin 21.3 which is also in alignment with the halving center line extending perpendicularly to the cross bar 21.1.

Figure 18A:
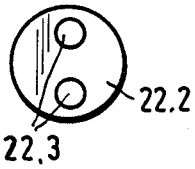
FIGS. 18, 18*a* and 18*b* are respective side and opposite end elevational views of a drive shaft of the preferred embodiment.
Figure 18:
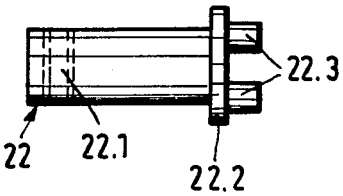
Figure 18B:
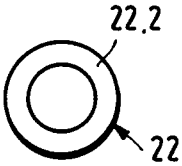

Also turning now to FIGS. 18, 18*a* and 18*b*, the drive shaft 22 is coupled with the bolt-operating knob 21 in a torque-transmitting (form-fitting) manner. For this purpose, the drive shaft 22 is provided adjacent one of its end faces with a transverse bore 22.1. After axially inserting the drive shaft 22 in a socket on the rear side of the bolt-operating knob 21, a setscrew is received in the transverse bore 22.1. At the opposite end the drive shaft 22 has a flange 22.2 on whose face oriented away from the drive shaft 22, there are secured diametrally arranged drive pins 22.3.

Figure 17:
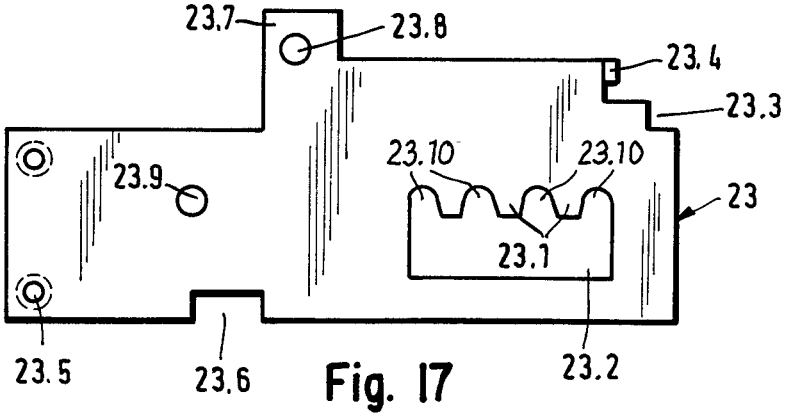
FIGS. 17 and 17*a* are respective side and end elevational views of a drive plate of the preferred embodiment.
Figure 17A:
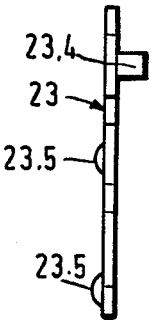

Turning now to FIGS. 17 and 17*a*, the drive plate 23 has, at a distance from the drive pins 22.3 of the drive shaft 22, a plurality of uniformly spaced teeth 23.1 formed in an edge of an opening 23.2 in the drive plate 23. Between the teeth 23.1 there are defined, as viewed from the left in FIG. 17, first, second, third and fourth notches 23.10 which are spaced from one another identically to the spacing between the two drive pins 22.3. The latter extend into the opening 23.2 of the drive plate 23 and cooperate with the notches 23.10 upon rotation of the drive shaft 22. In the zone of the opening 23.2 the drive plate 23 has a generally rectangular configuration which, at its upper outer corner (as viewed in FIG. 17) has a step-like cutout portion 23.3 as well as an angled tab 23.4. In the zone remote from the opening 23.2, the drive plate 23 is of reduced rectangular configuration, at the outer corners of which two protuberances (buttons) 23.5 are embossed. In the zone of the transition from the smaller to the larger rectangle of the drive plate 23, there is provided, at the lower edge thereof, a rectangular cutout 23.6 and, on the opposite side, at the upper edge, there is provided a projection 23.7 provided with a bore 23.8. Further, a bore hole 23.9 is provided in the drive plate 23 at the intersection of that edge of the cutout 23.6 which is closer to the buttons 23.5 and the connecting line of the teeth 23.1.

As seen in FIG. 4, the drive plate 23 is connected with an elongated locking bolt 19 and a rocker plate 24 by means of a pivot-and-carrier pin 25. Since the drive shaft 22 is supported stationarily for rotation in the housing 14, upon rotation of the drive shaft 22, the drive plate 23 is longitudinally displaced as a result of the cooperation between the drive pins 22.3 and the notches 23.10. The rocker plate 24 moves together with the drive plate 23. In the locking position, the rocker plate 24 is form-lockingly coupled with the toothed plate 18. When the toothed plate 18 is movable (which is permitted by virtue of the fact that all the locking bars 17 are in their proper position), the rocker plate 24 may pivot and release the locking bolt which, as will be described in more detail below, may be moved into the open position by the bolt-operating knob 21.

Turning now to FIG. 20, the rocker plate 24 has a rectangular window 24.1 having a lower edge engaged by the drive pins 22.3 rotated between the teeth 23.1 of the drive plate 23. The longitudinal directions of the window 24.1 and the rocker plate 24 define an acute angle; the rocker plate 24 is generally boot-shaped. In the zone of the upper end of the boot shaft, on the upper outer edge, there is formed a tab 24.2 whose outer edge 24.3 is angled as shown in FIG. 20*a*. At the opposite longitudinal end the rocker plate 24 has an embossed tip 24.4 (foot of the boot). Approximately in the center of the rocker plate 24 there is provided a hole 24.5 through which passes the pivot-and-carrier pin 25 which also traverses the hole 23.9 of the drive plate 23. Reverting to FIG. 4, the pin 25 also passes through a hole 19.1 of the locking bolt 19 which is arranged on that side of the rocker plate 24 which is oriented away from the drive plate 23. At its upper edge the locking bolt 19 is provided with an elongated rectangular notch (cutout) 19.2. In the closed position of the combination lock the notch 19.2 receives a spacer member 26.

Also referring to FIGS. 19 and 19*a*, the tip 24.4 of the rocker plate 24 abuts against a locking plate 27 which has generally the shape of an irregular pentagon having a partially rounded corner 27.1 engaged by the tip 24.4 of the rocker plate 24 and a fully rounded corner 27.6. The locking plate 27 is provided with a hole 27.2 which is located in the zone of the fully rounded corner 27.6 and through which a pin extends which also passes through the hole 18.2 of the toothed plate 18. If the tip 24.4 of the rocker plate 24 presses, transversely to the direction of motion of the locking bolt 19, against the partially rounded corner 27.1 of the locking plate 27, the latter, provided all the locking bars 17 are in the proper position of the combination, lifts the toothed plate 18 from the position shown in FIG. 4 to the position shown in FIG. 5. The locking plate 27 has a window 27.3 in its tapering zone opposite from the rounded corner 27.6, as shown in FIG. 19. The window 27.3 receives the spacer 26 arranged in the cutout 19.2 of the locking bolt 19. The spacer 26 provides for an additional safety measure against an opening movement of the locking bolt 19 as long as the locking plate 27 has not been swung into its releasing position. Approximately in the zone of connection between the bore 27.2 and the window 27.3, the locking plate 27 has a punched-out tab 27.4 extending perpendicularly to the plane of the locking plate 27.

As shown in FIG. 4, in the bore 23.8 provided in the projection 23.7 of the drive plate 23 there is fitted a post 28 for supporting a hairpin-shaped spring 29. One end of the spring 29 engages the angled outer edge 24.3 of the rocker plate 24, whereas the other end of the spring 29 engages the angled tab 23.4 of the drive plate 23. The hairpin-shaped spring 29 seeks to move away the outer edge 24.3 and the tab 23.4 from one another by relative motion of the rocker plate 24 and the drive plate 23 about the pivot-and-carrier pin 25.

Still referring to FIG. 4, a securing post 31 mounted in the housing 14 supports a hairpin-shaped spring 32 whose one leg engages an adjacent leg of the housing angle 14.1 of the housing 14, whereas its other leg engages a pin 27.5 which is secured to the locking plate 27 in a slot formed by bending out a tab 27.4 and which extends into the cutout 18.7 of the toothed plate 18.

In the starting position, as shown in FIG. 4, the two drive pins 22.3 are in engagement with the lower edge of the window 24.1 of the rocker plate 24 and further, the drive pins 22.3 are situated within the third and fourth notch 23.10 (as viewed from the left in FIG. 4) of the drive plate 23. In the starting position, the spacer member 26 is situated in the cutout 19.2 of the locking bolt 19. The tip 24.4 of the rocker plate 24 engages the partially rounded corner 27.1 of the locking plate 27.

Upon turning the drive shaft 22 supported in the bore 14.9 of the housing 14 (FIG. 12) about 90° (clockwise, as viewed in FIG. 4) the drive pin 22.3 situated in the fourth notch 23.10 moves downwardly, whereas the adjacent drive pin 22.3 (situated in the third notch 23.10) moves upwardly. The drive plate 23 and the rocker plate 24 are pivoted in opposite directions against the force of the spring 29 about the pivot-and-carrier pin 25. At the same time, the locking bolt 19 is shifted longitudinally one-quarter turn in the opening direction, whereby the pivotal axis of the pivot-and-carrier pin 25 also shifts. These motions can take place only if all the locking bars 17 are situated between the legs 18.8 of the toothed plate 18. A pivotal motion of the rocker plate 24 in a counterclockwise direction (as viewed in FIGS. 4 and 5) causes its tip 24.4 to be pressed against the locking plate 27 which, in response, moves the toothed plate 18 against the force of the spring 32 transversely to the motion of the locking bolt 19. During this occurrence, the tab 18.5 of the toothed plate 18 extends into a slot provided in the securing angle 14.1 of the housing 14. As a result of the motion of the locking plate 27 transversely to the locking bolt 19, the spacer member 26 is moved out of the cutout 19.2 of the locking bolt 19 which, as a result, may be opened further.

Figure 5:
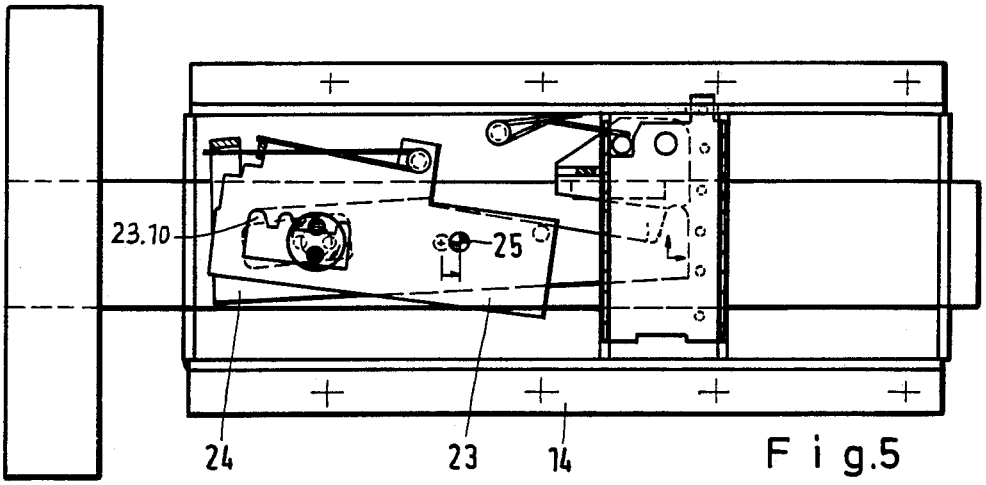
FIG. 5 is a view similar to FIG. 4, showing the locking bolt in a one-quarter turn opened position and the toothed plate in a raised position.
Figure 6:
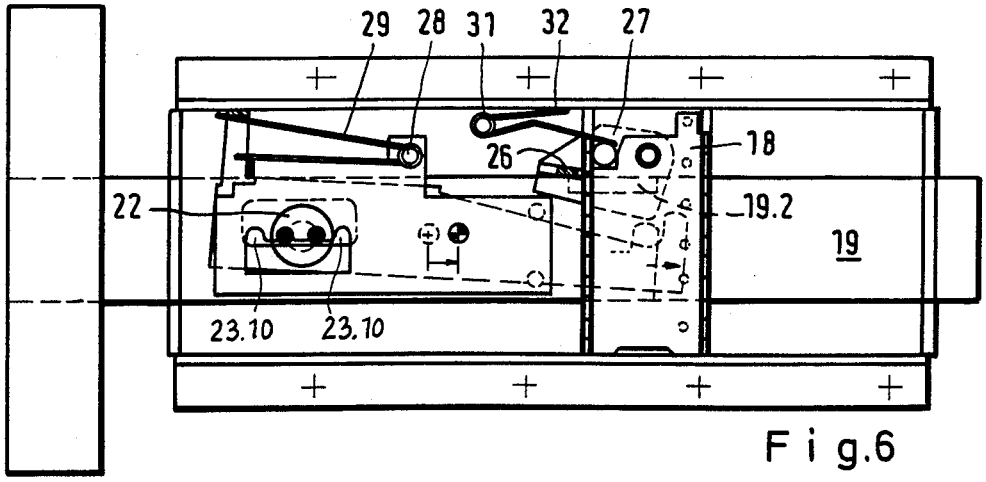
FIG. 6 is a view similar to FIG. 4, showing the locking bolt in a one-half turn opened position and the toothed plate in a lowered position.

Upon rotation of the drive shaft 22 through an additional 90° from the position shown in FIG. 5 to the position shown in FIG. 6, the rocker plate 24 and the drive plate 23 essentially assume their starting position with respect to one another. By virtue of the fact that the initially externally positioned drive pin 22.3 now fills the second notch 23.10 (as viewed from the left in FIG. 6), the pivot-and-carrier pin 25 shifts a further distance with the locking bolt 19 from its original position. In the position shown in FIG. 6, the tip 24.4 of the rocker plate 24 releases the locking plate 27 which, under the effect of the spring 32, moves back into its initial position together with the toothed plate 18 in a direction transversely to the motion of the locking bolt 19. Such a return motion, however, does not take place relative to its angular motion since the spacer member 26 engages the upper edge of the locking bolt 19. Thus, the locking bolt 19 is now opened one half-turn and the toothed plate 18 has dropped.

Figure 7:
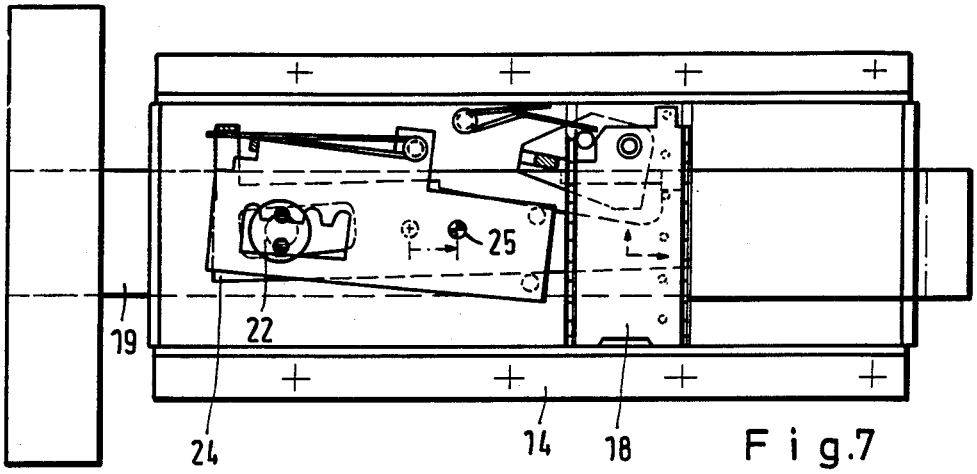
FIG. 7 is a view similar to FIG. 4, showing the locking bolt in a three-quarter turn opened position.
Figure 8:
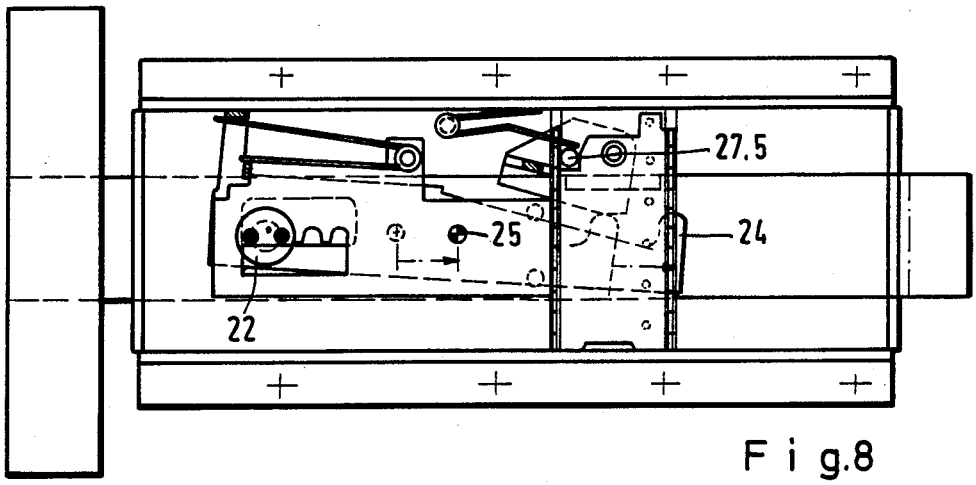
FIG. 8 is a view similar to FIG. 4, showing the locking bolt in a fully open position.

A further rotation of the drive shaft 22 by 180° from the position shown in FIG. 6 to the position shown in FIG. 8 (through the intermediary position illustrated in FIG. 7) results in a full opening of the locking bolt 19. During this operation the toothed plate 18 is not pivoted and the locking plate 27 is only slightly pivoted, since the rocker plate 24 remains disconnected from the locking plate 27. The locking bolt 19 is first opened to a three-quarter turn and eventually assumes its fully-open position.

Since between a half-open and a fully-open position of the locking bolt 19 the toothed plate 18 is not moved because the rocker plate 24 and the locking plate 27 are disconnected from one another, the combination lock may be half closed and again opened without the need to place the locking bars 17 into the combination position. The combination position thus may be cancelled in advance, whereby no visible display will appear for the unauthorized.

Figure 9:
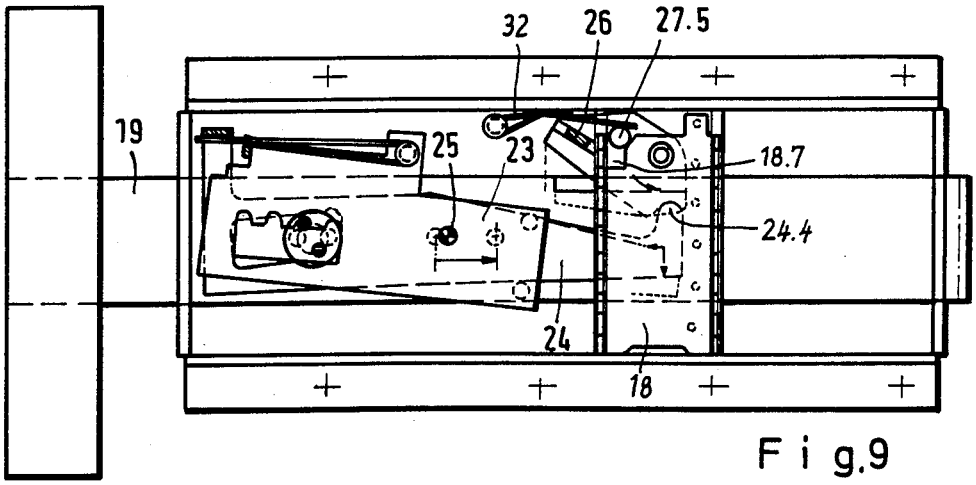
FIG. 9 is a view similar to FIG. 4, depicting the structure shortly before the locking bolt reaches its starting position during return movement.

The rocker plate 24 and the locking plate 27 enter into mutual engagement with one another only after the combination lock is returned to its starting position. To open the combination lock anew, it is then necessary—because of the motion of the locking plate 18—that all the locking bars 17 assume their position corresponding to the set combination. FIG. 9 shows the combination lock immediately prior to the return into the closed position. The tip 24.4 of the rocker plate 24 slides along the partially rounded corner 27.1 of the locking plate 27 and pivots the latter against the force of the spring 32 in a clockwise direction about the pin 27.5. At the same time, the pin 27.5 swings out of the opening 18.7 of the toothed plate 18 without moving the latter. The tip 24.4 of the rocker plate 24 thus may pass by the locking plate 27 and the combination lock may assume its closed position.

In the combination lock according to the invention the externally visible display of the combination is cancelled as soon as the bolt-operating knob 21 has executed one full revolution.

Turning now to FIG. 1, on the drive shaft 22 there is mounted a carrier disc 33 of circular configuration, arranged exterior of the plate 12. At a distance from and concentrically with a central bore 33.1 through which the drive shaft 22 passes, the disc 33 has an opening 33.2 shaped as an annular segment into which extends the carrier pin 21.3 of the bolt-operating knob 21. The disc 33 has a carrier lug 33.3 which is symmetrically spaced from the ends of the opening 33.2. On its outer periphery the carrier disc 33 is serially colored red, yellow and green. These colors appear behind the observation window 21.2 of the bolt-operating knob 21. Red indicates the closed position of the combination lock locking bolt 19; this position may be changed only after the combination has been properly dialed. Yellow indicates an intermediate position in which the locking bolt 19 is between open and half-closed positions. In the intermediate position the lock may be opened without dialing the combination. Green indicates the fully open position.

Figure 21:
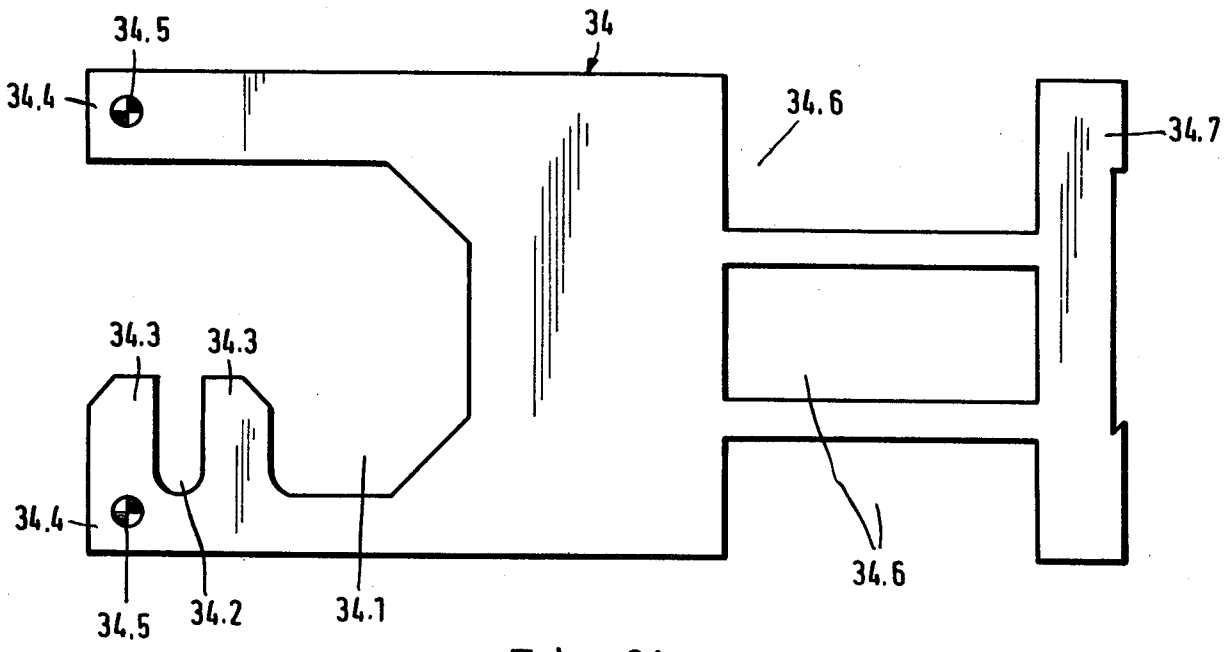
FIG. 21 is a side elevational view of a carrier plate of the preferred embodiment.

Referring to FIGS. 1, 10 and 21, the carrier lug 33.3 of the carrier disc 33 extends into a carrier plate 34 which is guided in the housing 14 between the door 11 and the code bars 15. The carrier plate 34 has a cutout 34.1 which is open towards the plate end. In the cutout 34.1 there is formed a transverse slot 34.2 which is defined by two projections 34.3 and which extends parallel to the adjoining frontal edge of the carrier plate 34. The transverse slot 34.2 receives the carrier lug 33.3 of the carrier disc 33. A button 34.5 is embossed in the legs 34.4 bounding longitudinally the cutout 34.1 of the carrier plate 34. The substantially rectangular cutout 34.1 which has bevelled inside corners, is so dimensioned that it permits the carrier pin 21.3 to be turned fully within its outline. The carrier plate 34 has three windows 34.6 at its end remote from the cutout 34.1. The two flanking (outer) windows are open in the direction of the longitudinal side of the carrier plate 34. Through each window 34.6 there pass, in a pairwise arrangement, the lugs 13.2 of adjoining digit slides 13. Upon motion of the carrier plate 34 in the direction of the opening of the cutout 34.1, the digit slides 13 are carried by a transverse member 34.7 which forms an end of the carrier plate 34 and which bounds the windows 34.6. As a result of such a motion of the carrier plate 34, the digit slides 13 are shifted into the zero position. The length of each window 34.6 equals that of the digit width 13.3. Thus, in the starting position of the combination lock, each digit slide 13 may be shifted, within the windows 34.6, to a position corresponding to a digit from 0 to 9.

A rotation of the bolt-operating knob 21 about 180° in a clockwise direction will cause no return motion of the slides 13. As a result of such a rotation, however, behind the display window 21.2 of the bolt-operating knob the red color is replaced by the yellow color, corresponding to a transition from the position shown in FIG. 1 to the position shown in FIG. 2. During this rotation there occurs a verification whether the combination lock is dialed to the proper combination as it was described above in conjunction with FIGS. 4, 5 and 6. Of two abutment pins 35 secured to the housing 14, the inner abutment pin, as before, engages into the annular segment 33.2 at a corner thereof formed by the end and the inner side. The carrier pin 21.3 of the knob 21 is rotated within the annular segment 33.2 from its lower position into its upper position, while the observation window 21.2 is moved from its upper position into its lower position.

Figure 2:
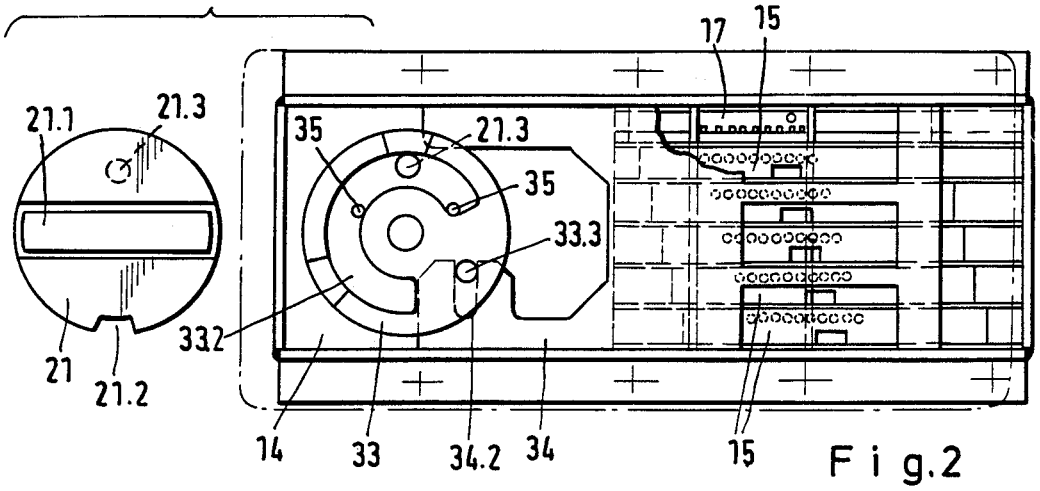
FIG. 2 is a view similar to FIG. 1, showing the combination lock in a position in which the locking bolt is one-half turn open.
Figure 3:
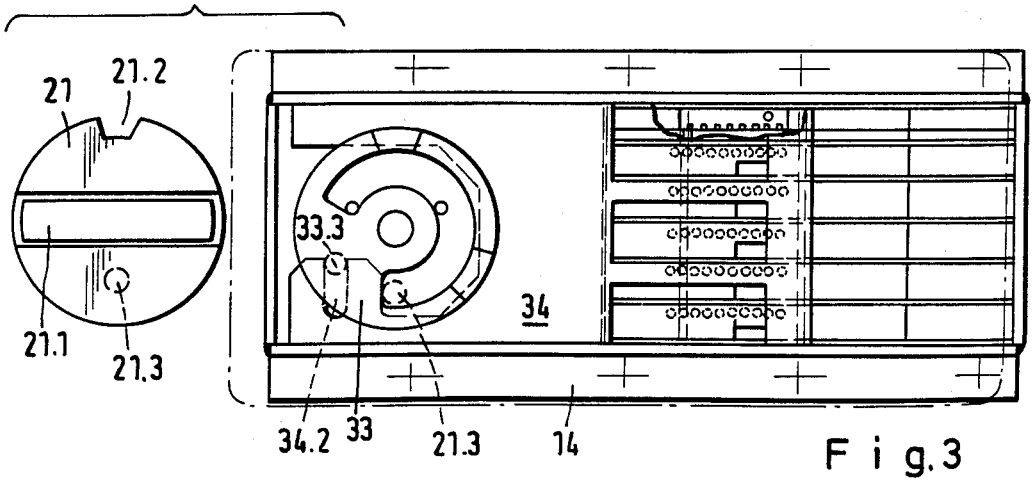
FIG. 3 is a view similar to FIGS. 1 and 2, showing the combination lock in a position in which the locking bolt is in a fully-open position.

Upon further rotation of the bolt-operating knob 21 by 180° from the position shown in FIG. 2 to the position shown in FIG. 3, the carrier pin 21.3 abuts the frontal boundary of the circular segment 33.2. From the time such an abutting relationship is established, the carrier pin 21.3 entrains the carrier disc 33, whose carrier lug 33.3 projects into the slot 34.2 of the carrier plate 34. The entrainment of the carrier disc 33 causes, by virtue of simultaneous rotation of the carrier lug 33.3, a shift of the carrier plate 34 in the direction of the opening provided in the cutout 34.1. Upon this motion, the carrier lug 33.3 first slides in the slot 34.2 downwardly and subsequently moves therein in an upward direction. The rotary motion of the carrier disc 33 and thus the longitudinal motion of the carrier plate 34 is terminated when the circular annular segment 33.2 abuts the outer abutment pin 35 with its opposite end. At this time, the last-named abutment pin 35 engages the corner between the inner boundary and the end face of the annular segment 33.2. Upon displacement of the carrier plate 34 in the direction of the opening of the cutout 34.1, the transverse member 34.7 of the carrier plate 34 contacts in sequence all the lugs 13.2 of the digit slides 13 and brings the latter into the zero position. Behind the observation window (not shown in the drawing) for the digit slides 13 at this time the digit 0 appears throughout. Behind the observation window 21.2 of the bolt-operating knob 21 the green color appears. Between the half-open and fully-open positions (FIGS. 2 and 3 as well as FIGS. 6, 7 and 8) the combination lock may be actuated without the need to dial the combination anew. If, however, the combination lock is fully closed (as shown in FIG. 1 and as described in connection with FIG. 4) the lock may be opened only if the combination is again dialed.

It will be understood that the above description of the present invention is susceptible to various modifications, changes and adaptations, and the same are intended to be comprehended within the meaning and range of equivalents of the appended claims.

What is claimed is:

1. A combination lock mounted on a door comprising:

(a) a lock housing;

(b) a locking bolt having a fully-open and a fully-closed position and being supported in said housing for executing displacements in bolt-opening and bolt-closing directions;

(c) a manually operable bolt-operating knob;

(d) drive means for connecting said bolt-operating knob with said locking bolt for displacing said locking bolt in response to operation of said bolt-operating knob;

(e) a plurality of side-by-side arranged displaceable locking bars each having a predetermined position dependent upon a set combination;

(f) means for preventing said locking bolt from movement from said fully-closed position unless each said locking bar is in its predetermined position;

(g) a plurality of displaceable code bars connected to said locking bars; each said locking bar being associated with a separate said code bar;

(h) a plurality of displaceable digit slides each having an externally accessible, manually engageable portion, a plurality of digit markings and a lug passing through said door and operatively engaging into the associated code bar, whereby manual displacement of any of said digit slides effects displacement of the associated locking bar with the intermediary of the associated code bar;

(i) a movable carrier plate situated in said housing between said door and said code bars and being traversed by said lugs, whereby said locking bars, said code bars and said digit slides are displaced by said carrier plate during a motion thereof in a direction opposite said bolt-opening direction; and (j) coupling means for connecting said bolt-operating knob with said carrier plate for moving said carrier plate in a direction opposite said bolt-opening direction during displacement of said locking bolt in said bolt-opening direction.

2. A combination lock as defined in claim 1, further comprising a slide-support plate mounted externally on said door for supporting said digit slides; means defining an observation window in said slide-support plate for rendering visible digits corresponding to a momentary position of the digit slides; and means defining slots in said slide support plate; said manually engageable portion of said digit slides projecting through said slots.

3. A combination lock as defined in claim 1, further comprising (k) a grooved plate mounted in said housing and provided with a plurality of parallel-spaced grooves for supporting, for a sliding movement, respective said locking bars;

(l) a setscrew connecting each said locking bar with the associated code bar; and (m) means defining an opening in said housing; said setscrew being accessible through said opening in said predetermined position of the respective said locking bar for changing a relative position between the locking bar and the associated code bar by manipulating the setscrew through said opening for arbitrarily changing the combination.

4. A combination lock as defined in claim 3, further comprising angled housing members forming part of said housing and being mounted on said door, said grooved plate being held by and between said angled housing members; a solid plate attached to said grooved plate in the vicinity of said bolt-operating knob, an opening defined in said solid plate for guiding said drive means.

5. A combination lock as defined in claim 3, wherein each said locking bar has, on a lateral face thereof, a series of spaced rectangular cutouts to form a toothed rack and a threaded bore provided adjacent one longitudinal end of each locking bar transversely to said lateral face for threadedly receiving said setscrew.

6. A combination lock as defined in claim 3, further comprising a plurality of detent bars arranged in coplanar relationship with said code bars; said code bars being in sliding engagement with said groove plate and being displaceable between said detent bars.

7. A combination lock as defined in claim 6, each said code bar having an opening into which the lug of the respective said digit slide projects.

8. A combination lock as defined in claim 7, wherein said opening in each code bar is of rectangular shape and is provided along a longitudinal lower edge thereof; further comprising a bore hole extending in each code bar from said longitudinal lower edge parallel to and spaced from the rectangular opening therein; a ball detent accommodated in said bore hole and cooperating with a respective said detent bar; each said code bar having a series of uniformly spaced threaded bores extending transversely to said bore hole for selectively receiving said setscrew.

9. A combination lock as defined in claim 1, further comprising (k) a drive plate forming part of said drive means;

(l) a rocker plate having a tip;

(m) a pivot-and-carrier pin pivotally securing said drive plate and said rocker plate to said locking bolt, whereby said drive plate and said rocker plate are displaced together with said locking bolt upon rotation of said bolt-operating knob;

(n) a spring exerting a torque on said drive plate;

(o) a locking plate engaged by said tip of said rocker plate; and (p) a toothed plate pivotally supporting said locking plate, said toothed plate being arranged for being blocked by abutment against any said locking bar not in said predetermined position; said toothed plate being further arranged for free motion past an end of said locking bars transversely to said locking bolt if all said locking bars are in said predetermined position.

10. A combination lock as defined in claim 9, wherein said toothed plate has oppositely located angled edges provided with teeth between which said locking bars are adapted to pass; said toothed plate having a tab at one end thereof for guiding, in said housing, said toothed plate in a lifted position thereof; said locking plate having a pin; said toothed plate further having a cutout for receiving said pin of said locking plate; an additional spring urging said pin of said locking plate into said cutout of said toothed plate; said locking plate having an additional pin; said toothed plate having a hole for receiving said additional pin.

11. A combination lock as defined in claim 9, wherein said drive plate includes an opening defined by an edge having a plurality of teeth defining uniformly spaced notches therebetween; said drive means including a drive shaft connected to said bolt-operating knob to be driven thereby; drive lugs mounted on said drive shaft and cooperating with said notches for moving said drive plate; said drive plate having, spaced from and in linear alignment with said teeth of said drive plate, a hole through which said pivot-and-carrier pin passes; said spring being a hairpin shaped spring having two spring legs; a spring support secured to said drive plate between said hole and said opening therein for supporting said spring; said drive plate further having a tab spaced from said spring support and engaging one of the legs of said spring.

12. A combination lock as defined in claim 11, further wherein said rocker plate includes a rectangular window having an edge engaged by said drive pins of said drive shaft; one end of said rocker plate adjacent said window carries a tab engaging the other leg of said spring: said tip being arranged at an end of said rocker plate remote from the tab thereof; said rocker plate further including a hole situated between said tip and said window and being traversed by said pivot-and-carrier pin.

13. A combination lock as defined in claim 9, wherein said locking plate has, in the zone of contact with said tip of said rocker plate, a rounded edge arranged such that upon motion of said locking bolt in the bolt-closing direction, said rocker plate may clear said locking plate.

14. A combination lock as defined in claim 13, wherein said locking bolt has a cutout along an upper edge; further comprising a spacer secured to said locking plate and extending into said cutout of said locking bolt in the fully-closed position thereof.

15. A combination lock as defined in claim 1, further wherein said bolt-operating knob has an eccentric carrier pin; said drive means including a drive shaft connected to said bolt-operating knob to be rotated thereby; further comprising a carrier disc supported on said drive shaft; said carrier disc having a carrier lug and an opening shaped as an annular segment; said carrier pin projecting into said opening of said carrier disc; said carrier plate having a length dimension and a slot transverse to said length dimension; said carrier lug projecting into said slot of said carrier plate.

16. A combination lock as defined in claim 15, said carrier plate having a cutout open towards one end of said carrier plate; said slot opening into said cutout in said carrier plate; said carrier plate further having another end in which windows are provided, bounded by a transverse bar; said lugs of said digit slides projecting through said windows of said carrier plate.

17. A combination lock as defined in claim 15, further comprising abutment pins secured to said housing and projecting into the annular segment-shape opening of said carrier disc for limiting an angular displacement thereof.

18. A combination lock as defined in claim 15, wherein said bolt-operating knob includes an observation window; said carrier disc having differently-colored zones being selectively displayed in said observation window dependent on a fully-closed, half-open and fully-open position of said locking bolt.

* * * * *